US008347436B2

(12) United States Patent
Flick et al.

(10) Patent No.: US 8,347,436 B2
(45) Date of Patent: Jan. 8, 2013

(54) ADAPTABLE MATTRESS CONVERSION

(75) Inventors: Roland E. Flick, Elma, NY (US); Karl H. Cazzini, Lindenhurst, IL (US)

(73) Assignee: Stryker Corporation, Kalamazoo, MI (US)

( * ) Notice: Subject to any disclaimer, the term of this patent is extended or adjusted under 35 U.S.C. 154(b) by 209 days.

(21) Appl. No.: 12/258,788

(22) Filed: Oct. 27, 2008

(65) Prior Publication Data

US 2009/0106898 A1 Apr. 30, 2009

Related U.S. Application Data

(60) Provisional application No. 60/984,047, filed on Oct. 31, 2007.

(51) Int. Cl.
*A47C 27/10* (2006.01)

(52) U.S. Cl. ..... 5/706; 5/710; 5/713; 5/717; 5/732

(58) Field of Classification Search ..... 5/706–715, 5/717, 731, 732

See application file for complete search history.

(56) References Cited

U.S. PATENT DOCUMENTS

| | | | | |
|---|---|---|---|---|
| 529,852 | A | | 11/1894 | Brupbacher |
| 1,276,361 | A | | 8/1918 | Hobert |
| 1,528,066 | A | | 3/1925 | McEntire |
| 3,513,489 | A | | 5/1970 | Miller et al. |
| 4,051,566 | A | | 10/1977 | Esquivel |
| 4,280,487 | A | | 7/1981 | Jackson |
| 4,803,744 | A | | 2/1989 | Peck et al. |
| 4,872,228 | A | | 10/1989 | Bishop |
| 4,934,002 | A | | 6/1990 | Watanabe |
| 4,947,500 | A | | 8/1990 | Seiler |
| 4,991,244 | A | | 2/1991 | Walker |
| 5,070,560 | A | | 12/1991 | Wilkinson |
| 5,107,558 | A | | 4/1992 | Luck |
| 5,249,318 | A | | 10/1993 | Loadsman |
| 5,765,246 | A | | 6/1998 | Shoehair |
| 5,794,289 | A | * | 8/1998 | Wortman et al. ..... 5/713 |
| 5,822,817 | A | | 10/1998 | Carew et al. |
| 5,926,883 | A | * | 7/1999 | Rechin et al. ..... 5/706 |
| 5,937,465 | A | | 8/1999 | Carew et al. |
| 5,963,998 | A | | 10/1999 | Carew et al. |
| 5,966,763 | A | | 10/1999 | Thomas et al. |
| 6,073,291 | A | | 6/2000 | Davis |
| 6,079,070 | A | | 6/2000 | Flick |
| 6,223,369 | B1 | | 5/2001 | Maier et al. |
| 6,493,888 | B1 | | 12/2002 | Salvatini et al. |
| 6,523,198 | B1 | | 2/2003 | Temple |
| 6,604,252 | B1 | | 8/2003 | Lee et al. |
| 6,735,800 | B1 | | 5/2004 | Salvatini et al. |
| 6,739,001 | B2 | | 5/2004 | Flick et al. |
| 6,767,621 | B2 | | 7/2004 | Flick et al. |

(Continued)

*Primary Examiner* — William Kelleher

(74) *Attorney, Agent, or Firm* — Warner Norcross & Judd LLP

(57) ABSTRACT

A mattress system has a cover, a crib, and a fluid bladder system. The crib surrounds the perimeter of the fluid bladder system and the cover overlies the top surface of the crib and fluid bladder system. The fluid bladder systems provide at least one conventional bladder therapy to a patient positioned on the mattress system. The fluid bladder system interconnects to the crib to not form a hammock effect so the crib functions as a restraint. The fluid bladder is also designed to bottom out to form an exterior cavity. A second cushion is inserted into the exterior cavity and positioned so the crib continues to function as a restraint. The second cushion provides a therapy to the patient that is different from the fluid bladder system.

30 Claims, 4 Drawing Sheets

U.S. PATENT DOCUMENTS

| | | | | |
|---|---|---|---|---|
| 6,782,574 | B2 | 8/2004 | Totton et al. | |
| 6,813,790 | B2 | 11/2004 | Flick et al. | |
| 6,859,967 | B2 | 3/2005 | Harrison et al. | |
| 6,912,743 | B1 * | 7/2005 | Weil | 5/93.1 |
| 7,007,330 | B2 | 3/2006 | Kuiper et al. | |
| 7,111,348 | B2 | 9/2006 | Ellis et al. | |
| 7,155,766 | B1 | 1/2007 | Gilchrest, Jr. et al. | |
| 7,197,780 | B2 | 4/2007 | Petric | |
| 7,203,984 | B2 | 4/2007 | Gardner et al. | |
| 7,296,315 | B2 | 11/2007 | Totton et al. | |
| 7,322,947 | B2 | 1/2008 | Flick et al. | |
| 7,380,302 | B2 | 6/2008 | Gilchrest, Jr. et al. | |
| 7,441,290 | B1 | 10/2008 | Flick | |
| 7,681,269 | B2 | 3/2010 | Biggie et al. | |
| 7,735,171 | B2 | 6/2010 | Kan | |
| 2003/0188388 | A1 | 10/2003 | Boso et al. | |
| 2003/0192127 | A1 | 10/2003 | Cook et al. | |
| 2004/0134433 | A1 | 7/2004 | Holder | |
| 2005/0081300 | A1 | 4/2005 | O'Reagan et al. | |
| 2006/0016016 | A1 | 1/2006 | Hornbach | |
| 2006/0090264 | A1 | 5/2006 | Boyd | |
| 2006/0101581 | A1 * | 5/2006 | Blanchard et al. | 5/713 |
| 2006/0272097 | A1 * | 12/2006 | Dionne et al. | 5/713 |
| 2007/0143928 | A1 * | 6/2007 | Biggie et al. | 5/715 |
| 2007/0234480 | A1 | 10/2007 | Crousore et al. | |
| 2007/0234481 | A1 | 10/2007 | Totton et al. | |
| 2007/0251012 | A1 | 11/2007 | Hill | |
| 2008/0271245 | A1 * | 11/2008 | Flick | 5/425 |
| 2009/0193580 | A1 * | 8/2009 | Gauger | 5/93.1 |
| 2010/0071137 | A1 * | 3/2010 | Doehler et al. | 5/713 |

* cited by examiner

ADAPTABLE MATTRESS CONVERSION

CLAIM OF PRIORITY

This application claims priority to U.S. provisional patent application Ser. No. 60/984,047; that was filed on Oct. 31, 2007.

FIELD OF THE INVENTION

The present invention is directed toward a mattress system that allows the mattress to provide various functions.

BACKGROUND OF THE INVENTION

Mattress Embodiments

Mattress systems can have a mattress material and a mattress function. The mattress materials can have cushioning materials. The cushioning materials include and are not limited to a conventional spring mattress, fluid bladders, gelastic material, foam and combinations thereof. The mattress materials can include (i) a crib around the cushioning material's perimeter, (ii) a partial crib around portions of the cushioning material's perimeter, (iii) support material positioned below the mattress material, and (iv) nothing surrounding the cushioning material. Whatever surrounds or does not surround the cushioning material, the mattress material has a top surface, a bottom surface, a head end, a foot end, a right side and a left side. Conventionally, the mattress material has a sheet overlying at least the top surface.

The sheet can be a natural fabric, a polymeric fabric, a MRSA resistant fabric or combinations thereof. The sheet's objective is to ensure the mattress material(s) is separate from the patient positioned over the mattress' top surface. That separation is desired so the patient does not soil or damage the mattress materials.

Depending on the mattress material used and the position of the mattress materials, the mattress system can perform one or more of the following known functions:

(a) rotation therapy—a first set of fluid bladders on the right side and a second set of fluid bladders on the left side wherein when one set is fully inflated the patient is partially rotated;

(b) vibration therapy—a vibration bladder, a bladder within a bladder or a vibrating device positioned below a bladder. Vibrating a patient support surface at a predetermined frequency, for example, 6 to 25 Hz. The frequency ranges of the modes can obviously be tailored to desired frequency ranges;

(c) percussion therapy—a percussion bladder, a bladder within a bladder or a percussion device positioned below a bladder. Percussioning the patient support surface at a predetermined frequency in a range of, for example, 1 to 5 Hz. The frequency ranges of the modes can obviously be tailored to desired frequency ranges;

(d) wave therapy—has a first set of bladders and a second set of bladders wherein the first set and the second alternate with each other—1,2,1,2 . . . —and wherein the first set is inflated with a fluid and then while the first set deflates the second set is inflated to create a wave sensation;

(e) low air loss therapy—used only with fluid bladders wherein the fluid is a gas, like air, and the gas is transmitted toward a patient through apertures in the fluid bladders to decrease the pressure applied by to the patient;

(f) decrease tissue interface pressure therapy—all of the above therapies including deep cell bladders (bladders over 5 inches in height), lower pressures at the head and foot ends, and/or gelastic cushion material (tri-block co-polymeric composition); and/or (g) thermal energy transfer therapy—controlling the thermal energy of the fluid directed into the bladders, for example, using Gaymar's MediTherm fluid temperature control device or Thermacare air temperature control device, to transfer the fluid's thermal energy to the patient; and/or using an electrical resistant material in the bladders to warm the patient.

More detailed explanations of these known therapies are set forth below:

Rotation Therapy

Rotating the patient on an inflatable mattress is a well known method to decrease and possibly avoid the formation of bed sores on immobile patients. Such a method is disclosed in U.S. Pat. No. 5,794,289 which is commonly assigned and is hereby incorporated by reference.

In U.S. Pat. No. 5,794,289, Wortman et al. describe a mattress unit having a plurality of air cells. The mattress unit rotates a patient by controlling the air pressure in each air cell by inflation and deflation. To rotate a patient to its right side requires deflating the right air cells and inflating the left air cells of a conventional rotation bladder embodiment. The rotation bladder embodiment is normally positioned below a patient surface contact bladder. That way, one side of the rotation bladders can be deflated and the patient does not bottom out unless there is an unintentional leak in the bladder or a CPR dump protocol is initiated. In the '289 patent, if the mattress is to be planar with a surrounding crib, the rotation bladders are inflated to a level that allows the top surface of the patient surface contact bladder to be level with the top surface of the crib.

The air pressure required to rotate the patient depends on the patient's weight, body type and various other parameters. The quantity of air pressure that rotates one patient, i.e., 30 degrees may rotate another patient, i.e., 5 degrees. For example, two female patients weigh 130 pounds, one patient is pear-shaped and the other is apple-shaped. The pear-shaped patient rotates 15 degrees with 10 mm Hg while an apple-shaped patient rotates 7 degrees with 10 mm Hg. Obviously each patient is unique and different. Therefore, the programming that controls the air pressure in each mattress unit must be altered to comply with each patient.

Programming an air pressure mattress unit requires a skilled technician. The skilled technician analyzes each patient and alters the programming to attain the desired rotation and air pressure. One means to avoid the expensive technician's analysis and re-programming is to create a self-monitoring mattress.

Previous self-monitoring air pressure mattresses have utilized electrical signal transmission devices and electrical signal receiving devices that sandwich the top and bottom of each bladder to monitor the bladder size. The bladder size corresponds to the desired rotation and air pressure. Such signal devices are disclosed in U.S. Pat. Nos. 7,322,947 and 5,926,883 (also commonly assigned and incorporated by reference) in addition to U.S. Pat. No. 5,794,289.

Vibration & Low Air Loss Therapy

In expired U.S. Pat. No. 4,280,487; Jackson discloses a vibratory patient support system for providing therapeutic vibrational action or forces to a patient suffering from a respiratory ailment. The vibratory patient support system includes a rigid support frame (a bed frame) and numerous fluid bladders positioned upon the support frame with each fluid bladder having an upper surface so that the fluid bladders form a patient support surface. The fluid bladders are pressurized and maintained at a predetermined pressure. This predetermined pressure may be a patient height and weight specific pressure profile. A vibrating component is provided separate from the apparatus for pressurizing and maintaining the fluid bladders at the predetermined pressure. The vibrating component vibrates at least a portion of the patient support surface at a predetermined frequency. In this manner, the fluid bladders are maintained at their predetermined pressure and the portion of the patient support surface are simultaneously vibrated at the predetermined frequency. The vibrating devices are further variably controllable so that an operator can vary the frequency, magnitude or amplitude, and duration of the vibrating therapy. The vibratory patient support system may include a specialty low air loss (apertures in the bladders that allow air to escape from the bladder toward the patient) bed configuration including vibrating means for vibrating a portion of the patient support surface of the low air loss sacs at the predetermined frequency.

Wave Therapy

Wave therapy is incorporated in numerous mattress systems manufactured by Gaymar Industries, Inc. A description of wave therapy is referred as an alternating pressure mattress system. The alternating pressure mattress system has a mattress including a plurality of narrow, parallel, closely-spaced, horizontally adjacent air sacks. Every other one of the air sacks forms a first group of air sacks being commonly connected for the introduction there into of pressurized air and the other air sacks form a second group of air sacks and being commonly connected for the introduction there into of pressurized air. A pump supplies the pressurized air to the first and second groups of air sacks and a control apparatus alternatingly inflates and deflates the first and second groups of air sacks for selected periods of time to create the wave therapy.

Vibration, Percussion & Rotation Therapy

In U.S. Pat. No. 7,111,348; Ellis et al. disclose a "mattress assembly includes a bottom cover having a bottom surface and upwardly extending sidewall surrounding bottom surface to define an interior region. Straps are coupled to bottom cover for securing the mattress assembly to a bed frame if desired. A plurality of air cushions are configured to be located within the interior region of mattress assembly. A pair of rotation cushions are located on bottom surface. The rotation cushions are stored in a normally deflated configuration on the bottom surface. Rotation cushions are selectively inflated and deflated to control rotation therapy of a patient located on the mattress assembly . . . . A pair of proportional valve assemblies are located in interior region adjacent a head end. A lower head cushion is located within interior region adjacent head end. Lower body cushions are located in the interior region spaced toward the foot end from lower head bladder. Transversely-extending support surface bladders are located on top of other bladders within a continuous interior volume of interior region. Support surface cushions cooperate to define a core portion and include a head cushion, a chest cushion [chest support surface cushion includes internal percussion/vibration (P/V) bladders], a seat cushion, and a foot cushion. Support cushions include inner bladder sections and outer bladder sections which are separately controllable from an air supply source. Air enters the mattress assembly from a blower or air supply of an air system through inlet. Inlet is coupled to an inlet of a percussion/vibration valve. Air supply through inlet is also coupled to valves via flexible, cloth tubes respectively."

Deep Cell and Low Air Loss Therapy

For a number of years, Gaymar has been manufacturing its Sof-Matt RSM Low-Air-Loss Mattress System. That mattress system 10 is illustrated at FIGS. 1 to 3 and has foam crib 12 surrounding a plurality of deep cell air bladders 14 interconnected to an air pump 114. Deep cell air bladders are a minimum of 5 inches tall. The foam crib 12 has a top surface 30. The air bladder 14 also has a top surface 82 and interconnects 99 to the foam crib at and/or near the bladder's top surface 82 to the restraint's top surface 30. That interconnection position was deemed critical to provide lateral stability to the mattress system 10 to make it easier for the patient to get in and out of bed and facilitating patient transfers. That interconnection and the size of the deep cell bladders in the mattress system makes it difficult, if not impossible, to have other therapy devices—bladders, foam, gelastic material—in the mattress system 10.

The air pump 114 provides air to the air bladder at least at two different inflation modes. The first inflation mode is referred to as maximum volume as illustrated in FIG. 2. At maximum volume, the air bladder's top surface 82 is planar to the crib's top surface 30. The second inflation mode is referred to as normal operating mode as illustrated in FIG. 3. Normal operating mode provides sufficient inflation to prevent the patient from bottoming out when not desired and sufficient pressure to decrease the formation of debuticus ulcers. ("Bottoming" refers to any state where the bladder's top surface is depressed to a point that it contacts the bladder's lower surface, thereby markedly increasing the interface pressure where the two surfaces contact each other and is not desired unless CPR needs to be administered.) The normal operating mode in the current embodiment of Gaymar's Sof-Matt RSM Low-Air-Loss Mattress System creates a hammock effect.

The hammock effect is sometimes correlated to increased tissue interface pressure, which is normally undesirable. Since the crib and bladders only form a hammock effect in the normal operating mode, the crib in Gaymar's Sof-Matt RSM Low-Air-Loss Mattress System is not a restraint because the patient can roll (a) off the patient support device or (b) into a position between the crib and the bed railing since the bladder's top surface 82 and crib's top surface 30 remain within a similar plane (item 40).

XPRT Mattress System

Gaymar Industries manufactures its XPRT mattress. The XPRT mattress is a self-contained pulmonary therapy mattress with selectable rotation, percussion, vibration, turn assist (a form of rotation therapy), automatic low-air-loss that also provides pressure relief. The bladders that provide those therapies are positioned within a crib. Those numerous therapies make it difficult to impossible for the XPRT mattress to form an external receiving cavity to receive secondary cushion embodiments that provide alternative cushion therapies.

Overlay Rotation Therapy

Flick in U.S. Pat. No. 6,079,070 discloses a rotation mattress overlay. The overlay is designed to be positioned over a mattress system not within the mattress system. A problem with an overlay embodiment is that the crib conformation is unable to be effectively used as a restraint to protect the user from falling off the mattress or the mattress overlay.

Compartment Mattresses

There are mattress systems having a plurality of self-contained mattress modules that are connected together like a puzzle. That puzzle embodiment allows the user of the mattress to select the desired hardness for each module and incorporate a bed pan or washing capabilities instead of a mattress module. Examples of such mattresses are disclosed in U.S.

Pat. No. 1,276,361 (Hobert—Aug. 20, 1918); U.S. Pat. No. 1,528,066 (McEntire—Mar. 3, 1925); U.S. Pat. No. 6,523,198 (Temple—Feb. 25, 2003); and U.S. Pat. No. 7,197,780 (Petrie—Apr. 3, 2007).

On Oct. 4, 1977, Esquivel obtained U.S. Pat. No. 4,051,566 for a "Mattress with Modifiable Cavity for Pregnant Women." This mattress system had a mattress section that moved (a) down to form a cavity to accommodate the lady's expanding abdomen and (b) up to a normal planar surface configuration to accommodate the lady's normal abdomen.

SUMMARY OF THE INVENTION

A mattress system has a cover, a crib, and a fluid bladder system. The crib surrounds the perimeter of the fluid bladder system and the cover overlies the top surface of the crib and fluid bladder system. The fluid bladder systems provide at least one conventional bladder therapy to a patient positioned on the mattress system. The fluid bladder system interconnects to the crib to not form a hammock effect so the crib functions as a restraint. The fluid bladder is also designed to bottom out to form an exterior cavity. A second cushion is inserted into the exterior cavity and positioned so the crib continues to function as a restraint. The second cushion provides a therapy to the patient that is different from the fluid bladder system.

DETAILED DESCRIPTION OF THE INVENTION

Figure 1:
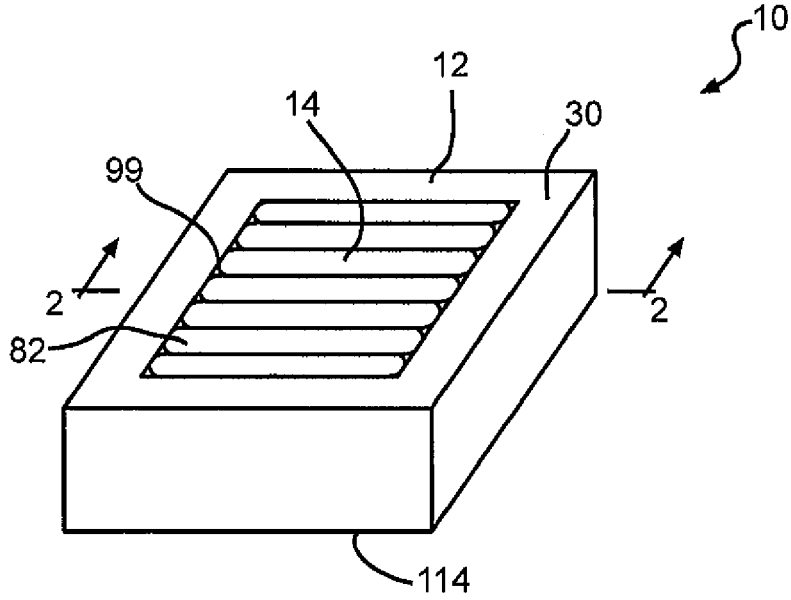
FIG. 1 (Prior Art)
FIG. 1 illustrates a prior art embodiment of a deep cell mattress.
Figure 2:
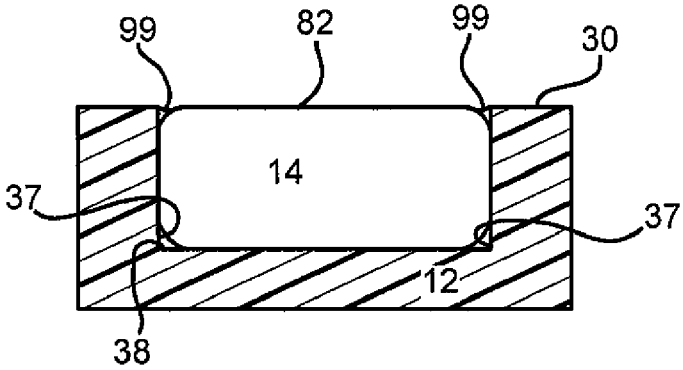
FIG. 2 (Prior Art)
FIG. 2 illustrates a cross-sectional view of FIG. 1 taken along the lines 2-2 and in a maximum inflate embodiment.
Figure 3:
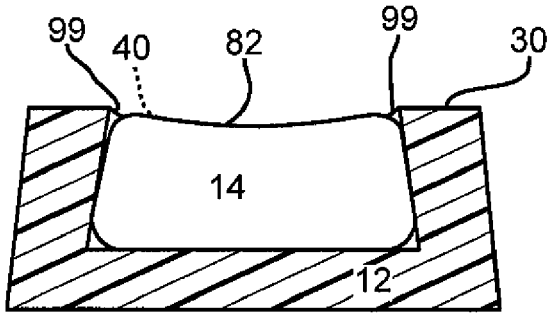
FIG. 3 (Prior Art)
FIG. 3 illustrates an alternative embodiment of FIG. 2 in a normal operating mode embodiment.
Figure 4:
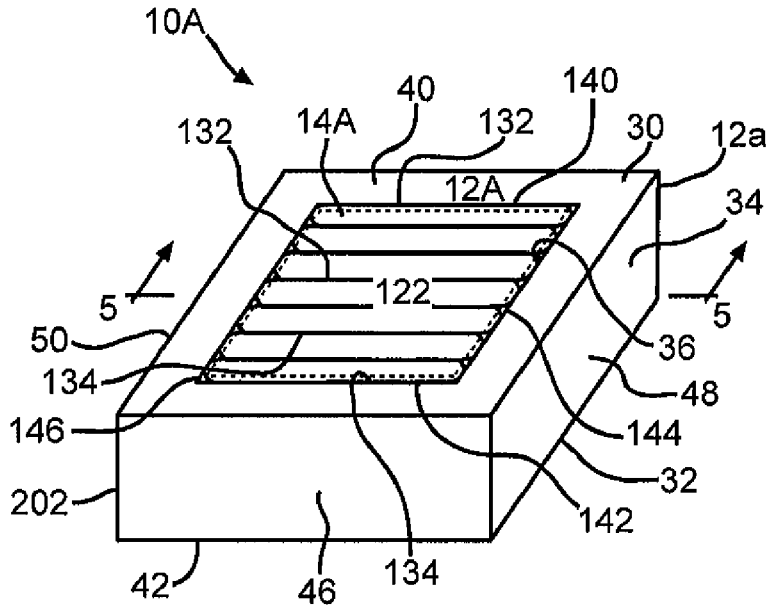
FIG. 4 illustrates the current invention highlighting the interconnection area of the bladders to the crib.

FIG. 4 illustrates an alternative embodiment of mattress system 10 (item 10*a*). The mattress system 10*a* has a restraint-crib 12*a*, a fluid pump 114 (see FIG. 7), a first fluid bladder system 14*a*, a top surface 40, a bottom surface 42, a head end 44, a feet end 46, a right side 48 and a left side 50. The restraint-crib 12*a* has a crib upper surface 30, a crib lower surface 32, an exterior surface 34 and an interior cavity 36 defined by interior wall surfaces 37 and interior base surface 38. The interior cavity 36 receives the first fluid bladder system 14*a*; and a first sheet 202 (illustrated as dotted lines) is positioned over at least the top surface 40 of the restraint-crib 12*a*, and the first fluid bladder system 14*a*.

The sheet 202 can be a natural fabric, a polymeric fabric, a MRSA resistant fabric or combinations thereof. The sheet's objective is to ensure the mattress material(s) is separate from the patient positioned over the mattress' top surface. That separation is desired so the patient does not soil or damage the mattress materials.

The first fluid bladder system 14*a* provides at least one of the above-identified mattress functions: (a) rotation therapy; (b) vibration therapy; (c) percussion therapy; (d) wave therapy; (e) low air loss therapy; (f) decrease tissue interface pressure therapy; and/or (g) thermal energy transfer therapy. For this application, we will assume the first fluid bladder system 14*a* decreases tissue interface pressure therapy through a deep cell bladder system.

Figure 5:
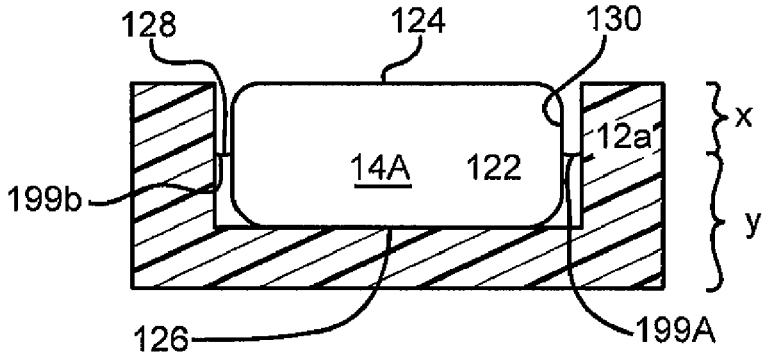
FIG. 5 illustrates a cross-sectional view of FIG. 5 taken along the lines 5-5 and in a maximum inflate embodiment.

As illustrated in FIGS. 4 and 5, the first fluid bladder system 14*a* has at least one inflatable bladder 122. Each inflatable bladder 122 has a top surface 124, a bottom surface 126, a left side 128, a right side 130, a head side 132, and a foot side 134. There can be one bladder or numerous bladders to form the cushioning section. Preferably there are numerous bladders. If numerous bladders are used, the bladders 122 are lined from the cushioning section's 14*a* head section 140 to foot section 142 as illustrated in FIG. 4 or from the cushioning section's 120 right side 144 to left side 146 or combinations thereof. In any embodiment, each bladder 122 is made of three layers of suitable puncture-resistant vinyl film or other suitable air impervious flexible material. However, the bladder may be made of two layers of air impervious flexible material, if desired.

For purposes of this invention, the inflatable bladder 122 is a deep cell inflatable bladder. A deep cell inflatable bladder is preferably at a minimum five inches in height.

Figure 6:
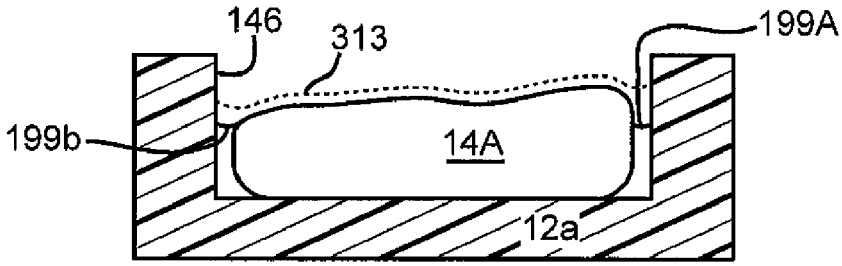
FIG. 6 illustrates a cross-sectional view of FIG. 5 during a normal operating mode embodiment.

The restraint-crib 12*a* is positioned adjacent to and attached (a) 199*a* to the cushioning section's right side 144 and (b) 199*b* to the cushion's left side 146, as best seen at FIGS. 5 and 6. In particular, the FIGS. 4, 5 and 6 embodiment has every bladder's 122 (a) left side 128 attached 199*b* to the restraint-crib 12*a* and (b) right side 130 attached 199*a* to the restraint-crib 12*a*.

An alternative embodiment has the "bladder positioned adjacent to the left side restraint" 122*a* attached 199*b* to the restraint 110 at intermittent locations that are separated by distances about equal to the width of the bladders 122, and the "bladder positioned adjacent to the right side restraint" 122*b* attached 919*a* to the restraint 110 at intermittent locations that are separated by distances about equal to the width of the bladders 122. The alternative embodiment has the left side 146 attached 199*b* to the restraint-crib 12*a* at intermittent locations that are separated by distances about equal to the width of the bladders 122, and the right side 144 is attached 919*a* to the restraint-crib 12*a* at intermittent locations that are separated by distances about equal to the width of the bladders 122.

The restraint-crib 12*a* extends the entire length of the right side 144 and left side 146. The restraint-crib 12*a* can be fluid bladders, foam, foam beads, gels, batting, or other suitable materials for restraining a user. What ever the restraint-crib material, the restraint-crib 12*a* is attached and in some case fluidly interconnected to the cushioning section 14. The restraint-crib can be covered by the conventional impermeable, medically accepted cover 202. Preferably the restraints are foam like materials surrounded by a cover and portions of the restraint (or restraint's cover) attaches to each bladder 120.

The bladder 122 and the restraint-crib 12*a* are attached 199 (a) directly to each other through heat welding, sonic welding, stitching or other conventional attachment methods used in the mattress industry or (b) indirectly to each other for example through a strap. The strap has a first end and a second end. The first end attaches to the bladder 122 and the second end attaches to the restraint-crib 12*a*. The straps are attached to the bladder or restraints through heat welding, sonic welding, stitching, other conventional attachment methods used in the mattress industry or combinations thereof. The attachment 199 should be sufficient to withstand the pressures applied by a patient positioned on the restraint/cushioning system 100 and the internal pressure provided by the fluid pump 114.

The fluid pump 114 inflates the bladders through at least two inflation modes. The first inflation mode is maximum inflate. Maximum inflate means every bladder 122 is fully inflated which results in every bladder's top surface 124 being on or within approximate area of the same plane as the restraint-crib' top surface 3. The maximum inflate is used when the patient is being transferred by patient assistants or the patient is authorized to egress from the restraint/cushioning system 100.

The second inflation mode is the normal operating mode. The normal operating mode provides sufficient inflation to prevent the patient from bottoming out and sufficient pressure to decrease (a) the formation of debuticus ulcers and (b) the tissue interface pressure. The tissue interface pressure decreases because the hammock effect is avoided.

The hammock effect is avoided and the restraints perform as restraints when the pump is in the normal operating mode involves attaching 199 the bladder 122 to restraint-crib's interior surface 154 at a first predetermined distance (x) below the restraint's top surface 30 and a second predetermined distance (y) above the restraint's bottom surface 32.

The first predetermined distance x is the distance below the restraint's top surface 30 wherein the restraint-crib 12*a* during the normal operating mode performs as a restraint as illustrated in FIG. 6, and simultaneously provides lateral stability to make the restraint/cushioning system 10*a* easier for the patient to get in and out of bed and facilitating patient transfers during the maximum inflate mode as illustrated in FIG. 5.

Bottoming the First Fluid Inflatable Bladder

Figure 7:
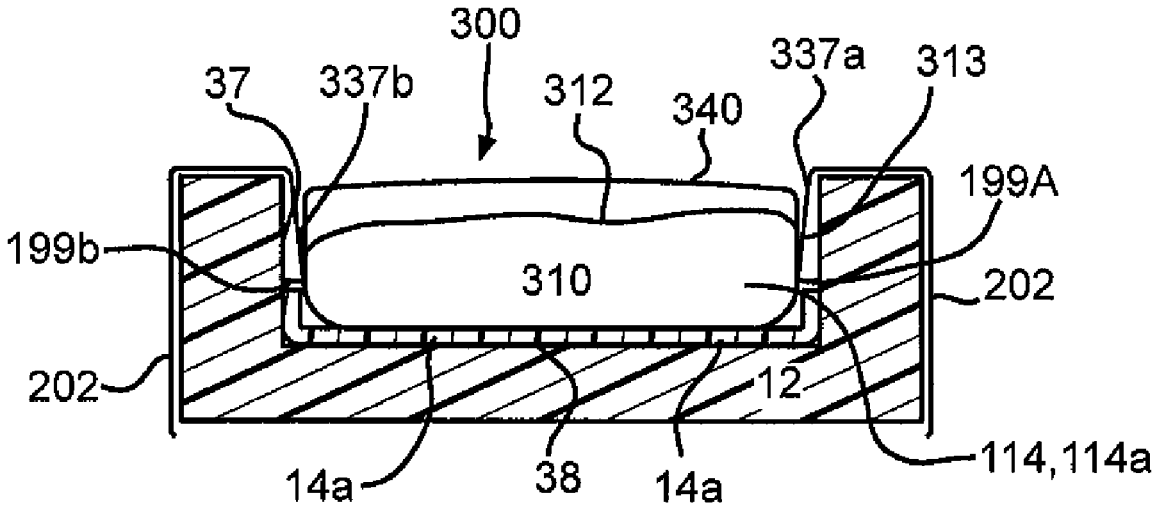
FIG. 7 illustrates a cross-sectional view of FIG. 5 during the bottoming out mode and with the second cushion material positioned in the crib's cavity.

As previously stated, bottoming the inflatable bladder is undesirable in prior mattress systems unless CPR is to be performed. Bottoming, however, is desired in this application when a second cushioning system 300 is used. To provide an alternative cushion embodiment without removing the first fluid bladder positioned under the first sheet 202, the first fluid bladder is bottomed out to form an external cavity 313 and the second cushioning system 300 having a second cushion material 310 is positioned between the patient and the bottomed out first fluid bladder as illustrated in FIG. 7.

The second cushion material 310 provides a second cushion embodiment that differs from the first fluid bladder's embodiment. The second cushion embodiment can be (1) a gelastic cushion, (2) a foam cushion, (3) a fluid bladder embodiment that provides (a) rotation therapy, (b) vibration therapy, (c) wave therapy, percussion therapy, (d) low air loss therapy, (e) thermal energy transfer therapy, (f) decreased tissue interface pressure (i.e., deep cell bladders), and (g) combinations thereof, and (4) combinations thereof. Some requirements for the second cushion material 310 are that the second cushion 310 provides different therapy functions than the first bladder embodiment that is positioned within the interior cavity 36. By positioned within the exterior cavity 313, the second cushion 310 contacts or comes close to contacting portions of at least opposing interior wall surfaces 337*a, b* that define the exterior cavity 313. The exterior cavity 313 is superimposed over the cavity 36. While securely positioned in the exterior cavity 313 the second cushion 310 has a top surface 312 positioned below the crib's top surface 30 plane. That way the crib 12*a* retains its restraint characteristics of inhibiting the patient from falling off the mattress system 10*a* while the second cushion 310 is used.

The cavity 36 can receive one or more second cushion materials 310. If additional second cushion materials are used in conjunction with a first second cushion material 310, the additional second cushion materials can provide the same therapy functions as the first bladder embodiment.

Gelastic Material

A gelastic material is a tri-block copolymer composition that provides elasticity and support. The compounds and how to create the gelastic materials are disclosed in U.S. Pat. No. 5,994,450 to Pearce and/or U.S. Pat. No. 5,633,286 to Chen. In U.S. Pat. Nos. 6,026,527 and 5,749,111, Pearce discloses the gelastic material can be made into a solid object or a cushion having columns.

The columned gelastic cushion material has been used by Gaymar, the assignee of this application, in its Isoflex mattress products. The columned gelastic material provides a non-powered mattress design that effectively redistributes pressure and manages shear, as well as treats patients with all stages of wounds.

Second Sheet

In a preferred embodiment, the second cushion material 310 is positioned within a second sheet 340. The second sheet should be used to not soil or damage the second cushion material. The second cushion material is positioned between (a) the patient and (b) the first sheet, and the deflated or deflating first fluid bladder 14*a*.

Installation of Second Cushion Material

In a preferred embodiment, the second cushion material 310 is positioned between the patient and the first sheet while the first fluid bladder 14*a* is in the process of bottoming out, and not bottomed out. By inserting the second cushion material 310 at that time, the patient does not bottom out. As previously stated, bottoming out could significantly increase the patient's tissue interface pressure, which is undesired. At the same time, if the first fluid bladder 14*a* is fully inflated while the second cushion material 310 is being positioned between the patient and the first sheet, the patient could fall off the mattress 10*a*. Again that result is undesirable. As such, an opportune time to initiate the insertion of the second cushion material 310 onto the first sheet 202 is when the first bladder 14*a* is in the process of deflating and the restraint-crib 12 acts as a restraining device.

If the second cushion 310 is a fluid bladder embodiment, the second cushion 310 can be interconnected to pump 114 or a second pump 114*a*. Obviously, if the fluid bladder provides rotation therapy Alternative Bladder Systems Generically, the first bladder 14*a* and the second cushion material 310 can provide a rotation function. For purposes of this description, we will address the bladder embodiment in relation to the first bladder 14*a* with the understanding that the bladder configuration can also be used with the second cushion material 310.

Figure 8:
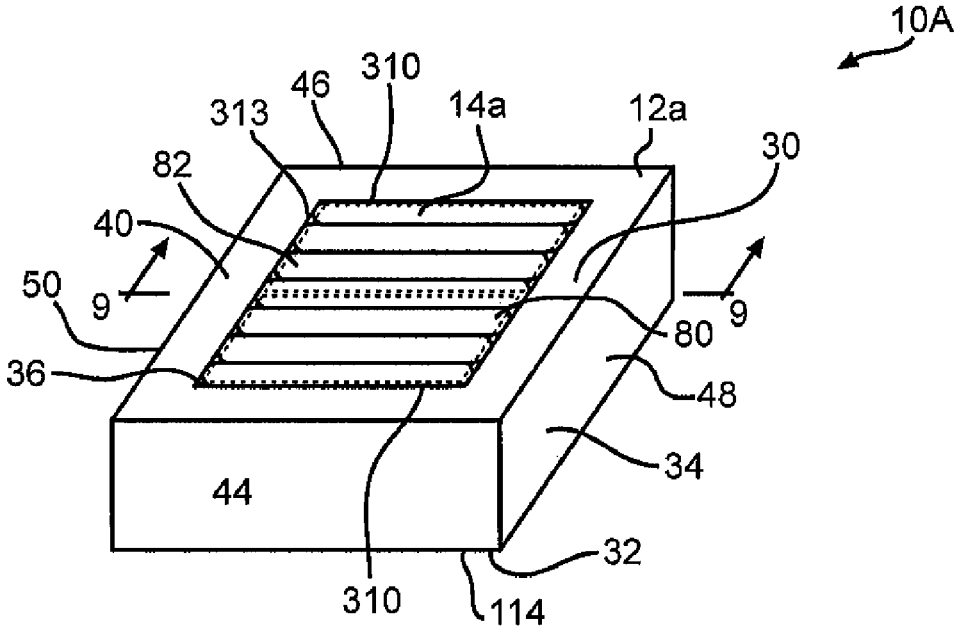
FIG. 8 illustrates a perspective view of the current invention having a second cushion positioned over a rotating therapy first bladder system during an initial bottoming out mode.

The rotation therapy is accomplished with at least a first rotation bladder 80 on the right side of the interior cavity 36 and a second rotation bladder 82 on the left side of the interior cavity 36 as illustrated in FIG. 8. If a patient positioned over the mattress system 10*a* is to be rotated to its left side (assuming the patient's back is adjacent to the top surface 40), the first rotation bladder 80 is fully inflated while the second rotation bladder 82's upper surface 84 is maintained level with the crib's upper surface 30 or positioned, by deflation, below the crib's upper surface so the crib 12*a* acts as a restraint. The crib 12*a* acts as a restraint to inhibit the patient from falling off the mattress system and/or into a position between the mattress support's rails and the mattress.

Figure 9:
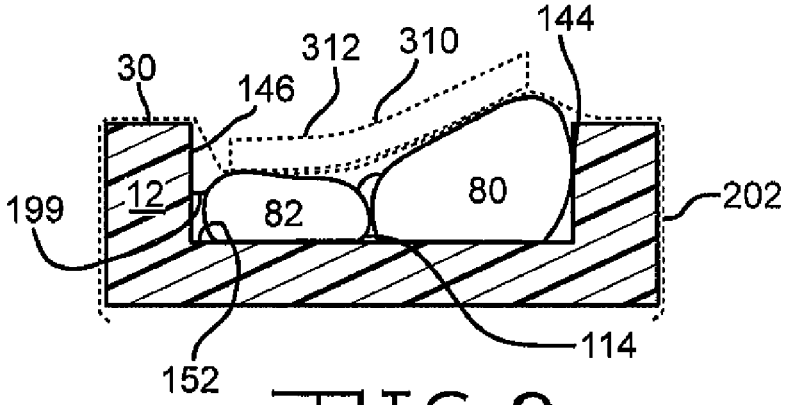
FIG. 9 illustrates a cross-sectional view of FIG. 8 taken along the lines 9-9.

In FIG. 9, the second inflatable cushion 310 is illustrated as having just been positioned over the first bladder system 14*a* just when the first bladder system 14*a* is initiated into a bottom out mode with the pump 114. As illustrated, a portion of the second cushion's top surface 312 is positioned below the crib's top surface 30 so the crib retains its ability to function as a restraint to inhibit the patient from falling off the mattress system.

Figure 10:
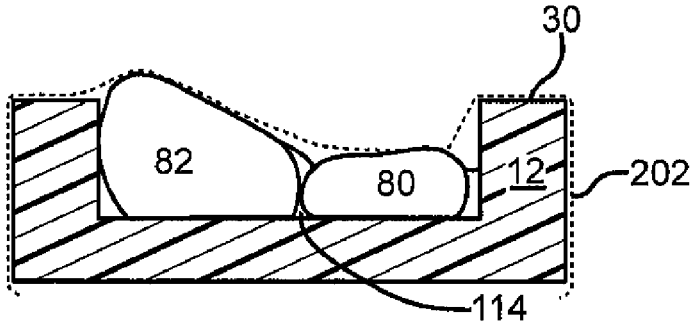
FIG. 10 illustrates an alternative embodiment of FIG. 9 during normal operating mode of the first fluid bladder.

Likewise, if the patient positioned over the mattress system 10*a* is to be rotated to its right side, the second rotation bladder 82 is fully inflated while the first rotation bladder 80's upper surface 86 is maintained level with the crib's upper surface 30, as illustrated at FIG. 10, or positioned, by deflation, below the crib's upper surface so the crib 12*a* acts as a restraint.

The bladder 80 and the interior cavity 36 are attached 199 (a) directly to each other through heat welding, sonic welding, stitching or other conventional attachment methods used in the mattress industry or (b) indirectly to each other for example through a strap. The attachment 199 should be sufficient to withstand the pressures applied by a patient positioned on the mattress system 10*a* and the internal pressure provided by a fluid pump 114.

The fluid pump 114 inflates the bladders through at least two inflation modes. The first inflation mode is maximum inflate. Maximum inflate means every bladder 14 is fully inflated which results in every bladder's top surface being on or within approximate area of the same plane as the crib's top surface 30. The maximum inflate is used when the patient is being transferred by patient assistants or the patient is authorized to egress from the mattress system 10.

The second inflation mode is the normal operating mode. The normal operating mode provides sufficient inflation to prevent the patient from bottoming out and sufficient pressure to decrease (a) the formation of debuticus ulcers and (b) the tissue interface pressure. The tissue interface pressure decreases because the hammock effect is avoided. "Bottoming" refers to any state where the bladder's top surface 66 is depressed to a point that it contacts the bladder's lower surface 67, thereby markedly increasing the interface pressure where the two surfaces contact each other and is not normally desired unless CPR needs to be administered.

The hammock effect is avoided and the crib perform as a restraint when the pump is in the normal operating mode involves attaching 199 the bladder 14 to each crib interior surface 36 at a first predetermined distance (x) below the crib's top surface 30 and a second predetermined distance (y) above the crib's interior cavity's bottom surface 152.

The interior cavity's bottom surface 38 may be foam material as illustrated or the support structure for the mattress system 10*a*.

In yet another alternative embodiment of the present invention, the cushioning section 14*a*, 310 may be of the alternating pressure type, i.e., it has at least two series of alternating cells, which are alternately inflated and deflated, one series of cells being inflated while the other series of cells is deflated. Such alternating pressure type cushions are disclosed, for example, in U.S. Pat. Nos. 5,794,289 and 5,901,393, which are hereby incorporated by reference in their entirety.

There have also been provided cushion and pump combinations in which alternate air chambers are alternately inflated and deflated to relieve excess pressure on patients at risk of developing pressure ulcers or to relieve excess pressure on patients with pressure ulcers (e.g., the Airflo Alternating Pressure System from Gaymar Industries, Inc.).

Micro-vents and/or low air loss tubes may also provided to produce a gentle flow of air beneath the patient to help minimize moisture build-up.

In a further embodiment of the present invention, the cushioning sections 14*a*, 310 may include a device for measuring the internal pressure of the cushioning sections 14*a*, 310. Typically, such devices activate a light when the internal pressure of the cushioning section 14*a*, 310 is below a certain level, indicating a bottoming condition. The device may be integrated into the valve through which fluid is being fed into the cushioning section 14*a*, 310. Such devices are well known in the art and are described, for example, in U.S. Pat. No. 5,140,309, which is hereby incorporated by reference in its entirety.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

We claim:

1. A mattress system comprising:

a crib having an exterior surface, a top surface, a bottom surface, and a cavity defined by an interior surface;

first and second attachment members joined to the crib interior surface;

a first fluid bladder system (a) having an upper surface and a lower surface, (b) positioned within the cavity, (c) attached to the crib interior surface through the first and second attachment members so the crib restrains a patient from falling off the mattress system when the first fluid bladder system entire top surface is not in the same plane or above the crib's top surface, and (d) that provides a first cushion therapy selected from the group consisting of (i) rotation therapy, (ii) deep cell bladder therapy, (iii) vibration/percussion therapy or (iv) alternating cushion therapy;

a first pump that directs a fluid into and/or out of the first fluid bladder system at (a) a maximum inflate mode so the first fluid bladder system entire top surface is in the same plane and/or above the crib's top surface, (b) a normal inflate mode to provide patient support and so at least a portion of the first fluid bladder system top surface is below the crib's top surface to allow the crib to function as a restraint, and (c) a bottoming out mode so the first fluid bladder system provides little to no patient support and forms an exterior cavity; and a removable second cushion that provides a second cushion therapy that is different from the first cushion therapy, and positioned (a) in the exterior cavity so the removable second cushion's top surface is positioned below the crib's top surface for the crib to remain a restraint for the mattress system and (b) over the first fluid bladder when the first fluid bladder system is deflated or in the process of being deflated.

2. The mattress system of claim 1 further comprising a first sheet over the top surface and the upper surface.

3. The mattress system of claim 2 wherein the second cushion is positioned above the first sheet.

4. The mattress system of claim 1 further comprising a second sheet for the second cushion.

5. The mattress system of claim 1 wherein the fluid is air.

6. The mattress system of claim 1 wherein the fluid is a liquid.

7. The mattress system of claim 1 wherein the second cushion therapy is selected from the group consisting of (A) second fluid bladders providing (i) rotation therapy, (ii) deep cell bladder therapy, (iii) vibration/percussion therapy, or (iv) alternating cushion therapy, (B) gelastic therapy, (C) foam therapy, or (D) combinations thereof.

8. The mattress system of claim 7 wherein the second fluid bladders further provide a low air loss therapy and/or thermal energy transfer therapy.

9. The mattress system of claim 1 wherein the first fluid bladder system is interconnected to the crib so the crib functions as a restraint instead of forming a hammock effect.

10. The mattress system of claim 1 wherein the first fluid bladders provide low air loss therapy and/or thermal energy transfer therapy.

11. The mattress system of claim 7 wherein the first pump provides the fluid to the second fluid bladders.

12. The mattress system of claim 7 further comprising a second pump that provides a fluid to the second fluid bladders.

13. A method of altering a mattress system comprising:

determining that a mattress system having a crib having an exterior surface, a top surface, a bottom surface, and a cavity defined by an interior surface;

first and second attachment members joined to the crib interior surface;

a first fluid bladder system (a) having an upper surface and a lower surface, (b) positioned within the cavity, (c) attached to the crib interior surface through the first and second attachment members so the crib restrains a patient from falling off the mattress system when the first fluid bladder system entire top surface is not in the same plane or above the crib's top surface, and (d) provides a first cushion therapy selected from the group consisting of (i) rotation therapy, (ii) deep cell bladder therapy, (iii) vibration/percussion therapy or (iv) alternating cushion therapy; and a first pump directs a fluid into and/or out of the first fluid bladder system at (a) a maximum inflate mode so the first fluid bladder system entire top surface is in the same plane and/or above the crib's top surface, (b) a normal inflate mode to provide patient support and so at least a portion of the first fluid bladder system top surface is below the crib's top surface to allow the crib to function as a restraint, and (c) a bottoming out mode so the first fluid bladder system provides little to no patient support and to form an exterior cavity;

needs to provide a different therapy;

initiating the bottoming out mode for the first fluid bladder system; and positioning a removable second cushion that provides a second cushion therapy that is different from the first cushion therapy (a) in the exterior cavity so the removable second cushion's top surface is positioned below the crib's top surface for the crib to remain a restraint for the mattress system and (b) over the first fluid bladder when the first fluid bladder system is deflated or in the process of being deflated.

14. The method of altering a mattress system of claim 13 further comprising providing a first sheet over the top surface and the upper surface.

15. The method of altering a mattress system of claim 14 wherein said providing includes positioning the second cushion above the first sheet.

16. The method of altering a mattress system of claim 13 further comprising providing a second sheet for the second cushion.

17. The method of altering a mattress system of claim 13 further comprising providing air as the fluid.

18. The method of altering a mattress system of claim 13 further comprising providing a liquid as the fluid.

19. The method of altering a mattress system of claim 13 further comprising providing the second cushion therapy selected from the group consisting of (A) second fluid bladders providing (i) rotation therapy, (ii) deep cell bladder therapy, (iii) vibration/percussion therapy, or (iv) alternating cushion therapy, (B) gelastic therapy, (C) foam therapy, and (D) combinations thereof.

20. The method of altering a mattress system of claim 19 further comprising providing a low air loss therapy and/or thermal energy transfer therapy with the second fluid bladders.

21. The method of altering a mattress system of claim 13 further comprising interconnecting the first fluid bladder system to the crib so the crib functions as a restraint instead of forming a hammock effect.

22. The method of altering a mattress system of claim 13 further comprising providing low air loss therapy and/or thermal energy transfer therapy with the first bladders.

23. The method of altering a mattress system of claim 19 further providing the fluid to the second fluid bladders with the first pump.

24. The method of altering a mattress system of claim 19 further comprising providing a fluid to the second fluid bladders with a second pump.

25. The method of altering a mattress system of claim 13 further comprising non-removably joining the first and second attachment members to the crib interior surface and to the first fluid bladder system.

26. The method of altering a mattress system of claim 13 further comprising connecting first and second laterally opposed sidewalls of the crib to the first and second attachment members, respectively.

27. The mattress system of claim 1 wherein the first and second attachment members are non-removably joined to the crib interior surface and to the first fluid bladder system.

28. The mattress system of claim 1 wherein the first fluid bladder system includes a lateral surface extending between the upper and lower surfaces, the first and second attachment members being joined to the first fluid bladder system lateral surface.

29. The mattress system of claim 1 wherein the crib interior surface includes first and second laterally opposed sidewalls connected to the first and second attachment members, respectively.

30. The mattress system of claim 29 wherein the first and second sidewalls terminate at an upper periphery, the first and second attachment members being connected to the respective first and second sidewalls below the upper periphery.

* * * * *